US005236316A

United States Patent [19]

Iio

[11] Patent Number: 5,236,316

[45] Date of Patent: Aug. 17, 1993

[54] SCROLL TYPE COMPRESSOR

[75] Inventor: Takayuki Iio, Nishikasugai, Japan

[73] Assignee: Mitsubishi Jukogyo Kabushiki Kaisha, Tokyo, Japan

[21] Appl. No.: 766,406

[22] Filed: Sep. 27, 1991

[30] Foreign Application Priority Data

Nov. 16, 1990 [JP] Japan ..... 2-311081

[51] Int. Cl.[5] ..... F04B 49/00

[52] U.S. Cl. ..... 417/307; 417/310

[58] Field of Search ..... 417/299, 307, 310

[56] References Cited

U.S. PATENT DOCUMENTS

| | | | |
|---|---|---|---|
| 4,840,545 | 6/1989 | Moilanen | 417/310 |
| 4,846,633 | 7/1989 | Suzuki et al. | 417/310 |
| 4,886,425 | 12/1989 | Itahana et al. . | |
| 4,890,987 | 1/1990 | Sato et al. | 417/310 |
| 4,904,164 | 2/1990 | Mabe et al. | 417/310 |
| 5,049,044 | 9/1991 | Hirano | 417/310 |
| 5,059,098 | 10/1991 | Suzuki et al. | 417/299 |

FOREIGN PATENT DOCUMENTS

| | | |
|---|---|---|
| 0354867 | 2/1990 | European Pat. Off. . |
| 3804418 | 10/1988 | Fed. Rep. of Germany . |
| 63-212789 | 9/1988 | Japan . |
| 62-264747 | 4/1989 | Japan . |
| 2083868 | 3/1982 | United Kingdom . |

*Primary Examiner*—Richard A. Bertsch
*Assistant Examiner*—Alfred Basichas

[57] ABSTRACT

A scroll type compressor has bypass ports communicating with chambers which are being compressed. The bypass parts are bored in an end plate of a stationary scroll. A capacity control block contained inside a bypass passage has the bypass ports communicating with a suction chamber formed in a housing. A piston valve for opening and closing this bypass passage and control valve which senses a discharge pressure and a suction pressure and generates a control pressure for operating the piston valve is formed separately from the stationary scroll. The capacity control block is installed in close contact with the outer surface of the end plate of the stationary scroll, thus controlling the output capacity of the compressor in a range from 0% to 100%.

12 Claims, 8 Drawing Sheets

SCROLL TYPE COMPRESSOR

FIELD OF THE INVENTION AND RELATED ART STATEMENT

The present invention relates to a scroll type compressor which is suitable for an air conditioner for vehicles and the like.

FIG. 8 thru FIG. 10 show an example of a conventional scroll type compressor.

In FIG. 8, a hermetic housing 1 consists of a cup-shaped main body 2, a front end plate 4 fastened thereto with a bolt 3, and a cylindrical member 6 fastened thereto with a bolt 5. A main shaft 7 which penetrates through the cylindrical member 6 is supported rotatably by the housing 1 through bearings 8 and 9.

A stationary scroll 10 is disposed in the housing 1, and the stationary scroll 10 is provided with an end plate 11 and a spiral wrap 12 which is set up on the inner surface thereof, and the end plate 11 is fastened to the cup-shaped main body 2 with a bolt 13, thereby to fix the stationary scroll 10 in the housing 1. The inside of the housing 1 is partitioned by having the outer circumferential surface of the end plate 11 and the inner circumferential surface of the cup-shaped main body 2 come into close contact with each other, thus forming a discharge cavity 31 on the outside of the end plate 11 and delimiting a suction chamber 28 on the inside of the end plate 11.

Further, a discharge port 29 is bored at the center of the end plate 11, and the discharge port 29 is opened and closed by means of a discharge valve 30 which is fastened to the outer surface of the end plate 11 with a bolt 36 together with a retainer 35.

A revolving scroll 14 is provided with an end plate 15 and a spiral wrap 16 which is set up on the inner surface thereof, and the spiral wrap 16 has essentially the same configuration as the spiral wrap 12 of the stationary scroll 10.

The revolving scroll 14 and the stationary scroll 10 are made to be eccentric with respect to each other by a radius of revolution in a solar motion, and are engaged with each other by shifting the angle by 180° as shown in the figure.

Thus, tip seals 17 buried at a point surface of the spiral wrap 12 come into close contact with the inner surface of the end plate 15, and tip seals 18 buried at a point surface of the spiral wrap 16 come into close contact with the inner surface of the end plate 11. The side surfaces of the spiral wraps 12 and 16 come into close contact with each other at points a, b, c and d so as to form a plurality of compression chambers 19*a* and 19*b* which form almost point symmetry with respect to the center of the spiral as shown in FIG. 10.

A drive bushing 21 is engaged rotatably through a bearing 23 inside a cylindrical boss 20 projected at a central part of the outer surface of the end plate 15, and an eccentric pin 25 projected eccentrically at the inner end of the main shaft 7 is inserted rotatably into an eccentric hole 24 bored in the drive bushing 21. Further, a balance weight 27 is fitted to the drive bushing 21.

A mechanism 26 for checking rotation on its own axis which also serves as a thrust bearing is arranged between an outer circumferential edge of the outer surface of the end plate 15 and the inner surface of the front end plate 4.

Now, when the main shaft 7 is rotated, the revolving scroll 14 is driven through a revolution drive mechanism consisting of the eccentric pin 25, the drive bushing 21, the boss 20 and the like, and the revolving scroll 14 revolves in a solar motion on a circular orbit having a radius of revolution in a solar motion, i.e., quantity of eccentricity between the main shaft 7 and the eccentric pin 25 as a radius while being checked to rotate on its axis by means of the mechanism 26 for checking rotation on its axis. Then, linear contact portions a to d between the spiral wraps 12 and 16 move gradually toward the center of the spiral. As a result, the compression chambers 19*a* and 19*b* move toward the center of the spiral while reducing volumes thereof.

With the foregoing, gas which has flown into a suction chamber 28 through a suction port not shown is taken into respective compression chambers 19*a* and 19*b* through opening portions at outer circumferential ends of the spiral wraps 12 and 16 and reaches the central part while being compressed. The gas is discharged therefrom to a discharge cavity 31 by pushing a discharge valve 30 open through a discharge port 29, and outflows therefrom through a discharge port not shown.

A pair of cylinders 32*a* and 32*b* one end each of which communicates with the suction chamber 28 are bored and these pair of cylinders 32*a* and 32*b* are positioned on both sides of the discharge port 29 and extend in parallel with each other in the end plate 11 of the stationary scroll 10 as shown in FIG. 9 and FIG. 10. Further, bypass ports 33*a* and 33*b* for bypassing gas during compression to the above-mentioned cylinders 32*a* and 32*b* from the inside of the pair of compression chambers 19*a* and 19*b* are bored in the end plate 11. Further, pistons 34*a* and 34*b* for opening and closing the bypass ports 33*a* and 33*b* are inserted in a sealed and slidable manner into these cylinders 32*a* and 32*b*.

Further, at the bottom of the cup-shaped main body 2 is fitted a control valve 38 which penetrates the bottom hermetically and partly projects outside. This control valve 38 senses the discharge pressure and the suction pressure and generates a control pressure which is an intermediate pressure of these pressures and may be expressed as a linear function of a low pressure as disclosed in Japanese Utility Model Provisional Publication No. 1-34485 (No. 34485/1989), Japanese Utility Model Provisional Publication No. 1-179186 (No. 179186/1989) and the like.

When the compressor is in full-load operation, the high pressure control gas generated in a control valve 38 is introduced to respective inner end surfaces of the pistons 34*a* and 34*b* via through holes 39*a* and 39*b*. Then, respective pistons 34*a* and 34*b* are made to advance against resiliency of return springs 41*a* and 41*b* which are interposed in a compressed state between those pistons and spring shoes 40*a* and 40*b*, thereby to block the bypass ports 33*a* and 33*b*.

On the other hand, the pressure of control gas generated from the control valve 38 is decreased when the compressor is in unload operation. Then, respective pistons 34*a* and 34*b* move back by the resiliency of the return springs 41*a* and 41*b* to occupy positions shown in the figure, and the gas which is being compressed passes through the bypass ports 33*a* and 33*b* from the pair of compression chambers 19*a* and 19*b* and outflows into the suction chamber 28 through communication holes 42*a* and 42*b* and blind holes 43*a* and 43*b* bored in the pistons 34*a* and 34*b* and the cylinders 32*a* and 32*b*.

In such a manner, capacity control is made in accordance with the load in the above-described scroll type compressor.

In the above-described conventional compressor, however, the compression chambers 19*a* and 19*b* are formed point-symmetrically with respect to the center of the spiral. Therefore, in order to bypass the gas which is being compressed to the suction chamber 28 side from these compression chambers 19*a* and 19*b*, respectively, it is required to form a pair of bypass ports 33*a* and 33*b* and a pair of cylinders 32*a* and 32*b* in the end plate 11, and to provide two sets of pistons 34*a* and 34*b*, return springs 41*a* and 41*b*, spring shoes 40*a* and 40*b* and the like in these pair of cylinders 32*a* and 32*b*, respectively. Therefore, there has been such problems that the structure becomes complicated, thus increasing the number of parts and the assembly/working manhours and also increasing the cost and the weight.

Further, since a part of the control valve 38 is projected outside the housing 1 so as to be fitted to the housing 1 hermetically, not only the outside dimension of the compressor becomes large, but also there has been such a fear that the control valve 38 hits against an obstacle and is broken in handling the compressor. Moreover, the fitting structure and the seal structure for fitting the control valve 38 become complicated and the fitting manhours are increased. In particular, there has been such a problem that it is very difficult to introduce the discharge pressure and the suction pressure into the control valve 38 and to introduce the control pressure generated in this control valve 38 into the cylinders 32*a* and 32*b*, thus increasing manhours.

OBJECT AND SUMMARY OF THE INVENTION

It is an object of the present invention which has been made in view of such circumstances to provide a scroll type compressor for solving the above-described problems, and the gist thereof will be described hereunder.

(1) A scroll type compressor in which a stationary scroll and a revolving scroll formed by setting up spiral wraps on end plates, respectively, are made to engage with each other while shifting the angle so as to form compression chambers, the stationary scroll is installed fixedly in a housing, and the revolving scroll is made to revolve in a solar motion by means of a mechanism for driving revolution while checking rotation on its axis by a mechanism for checking rotation on its axis, thereby to move the compression chambers toward the center of the spiral while reducing volumes thereof so as to compress gas, thus discharging the compressed gas into a discharge cavity formed in the housing through a discharge port provided in the end plate of the stationary scroll, characterized in that bypass ports which communicate with the compression chambers are bored in the end plate of the stationary scroll, a capacity control block contained inside a bypass passage which has the bypass ports communicate with the suction chamber formed in the housing, a piston valve which opens and closes the bypass passage, and a control valve which senses a discharge pressure and a suction pressure and generates a control pressure for operating the piston valve is formed separately from the stationary scroll, and the capacity control block is made to come into close contact with the outer surface of the end plate of the stationary scroll and installed fixedly in the housing.

(2) A scroll type compressor according to the above-described item (1), characterized in that the piston valve and the control valve are installed in parallel with each other.

The above-described construction being provided in the present invention, the operation is such that bypass ports communicate with a suction chamber in the housing through the bypass passage of the capacity control block by having the capacity control block come into close contact with the outer surface of the end plate of the stationary scroll so as to be installed fixedly in the housing. The control pressure generated in the control valve is applied to the piston valve so as to operate this piston valve, thus opening and closing the bypass passage. With this, the capacity of the compressor is controlled.

According to the present invention, working of the stationary scroll and the capacity control block becomes easier, thus making it possible to reduce the cost of the compressor by a large margin and to reduce the weight thereof.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 1 thru FIG. 7 show a first embodiment of the present invention, wherein:

FIG. 1 is a partial longitudinal sectional view;

FIG. 2 is a perspective view taken along a line II—II in FIG. 1;

FIG. 3 is a sectional view taken along a line III—III in FIG. 6;

FIG. 4 is a view taken along a line IV—IV in FIG. 6;

FIG. 5 is a sectional view taken along a line V—V in FIG. 4;

FIG. 6 is a sectional view taken along a line VI—VI in FIG. 4; and

FIG. 7 is a view taken along a line VII—VII in FIG. 5.

FIG. 8 thru FIG. 10 show an example of a conventional scroll type compressor, wherein:

FIG. 8 is a longitudinal sectional view;

FIG. 9 is a partial sectional view taken along a line IX—IX in FIG. 10; and FIG. 10 is a cross-sectional view taken along a line X—X in FIG. 8.

DETAILED DESCRIPTION OF A PREFERRED EMBODIMENT

Figure 1:
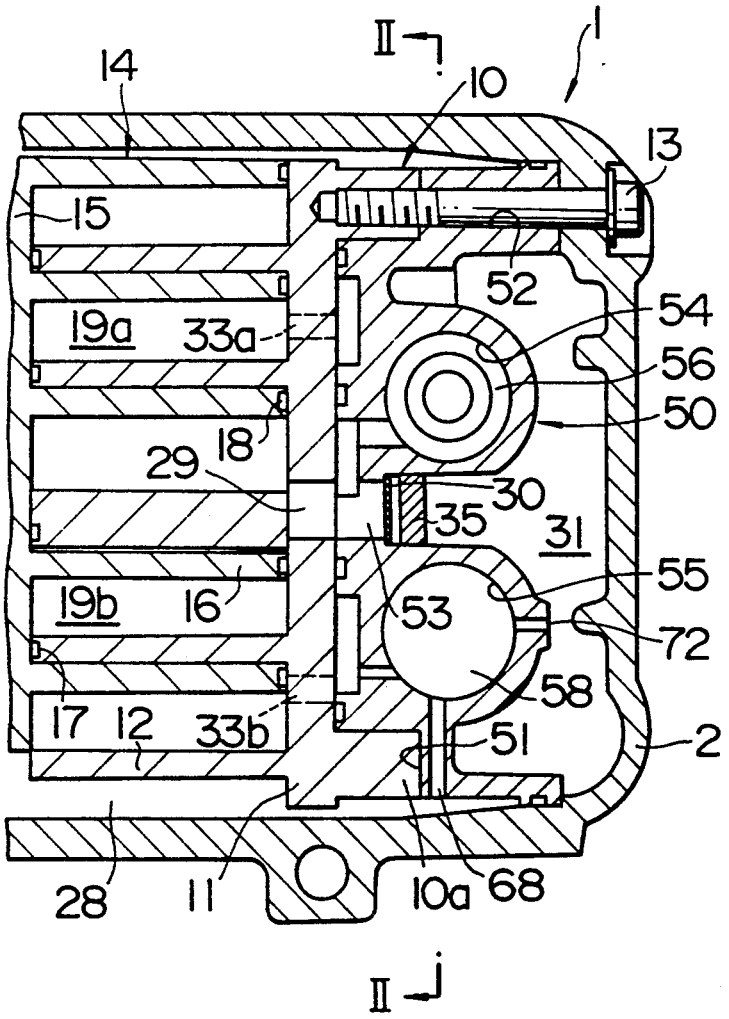
Figure 2:
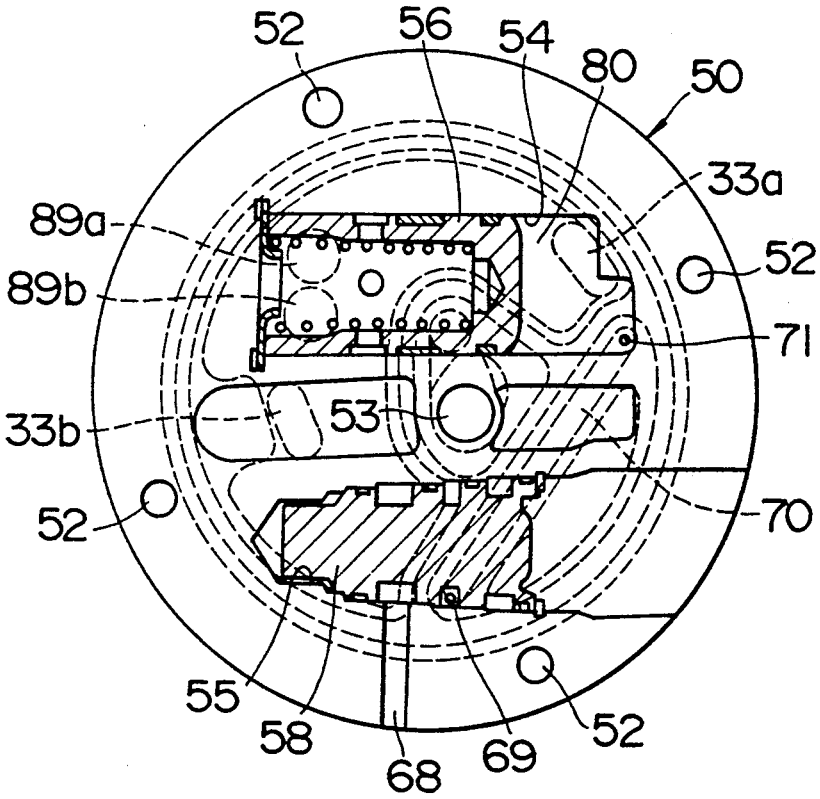
Figure 3:
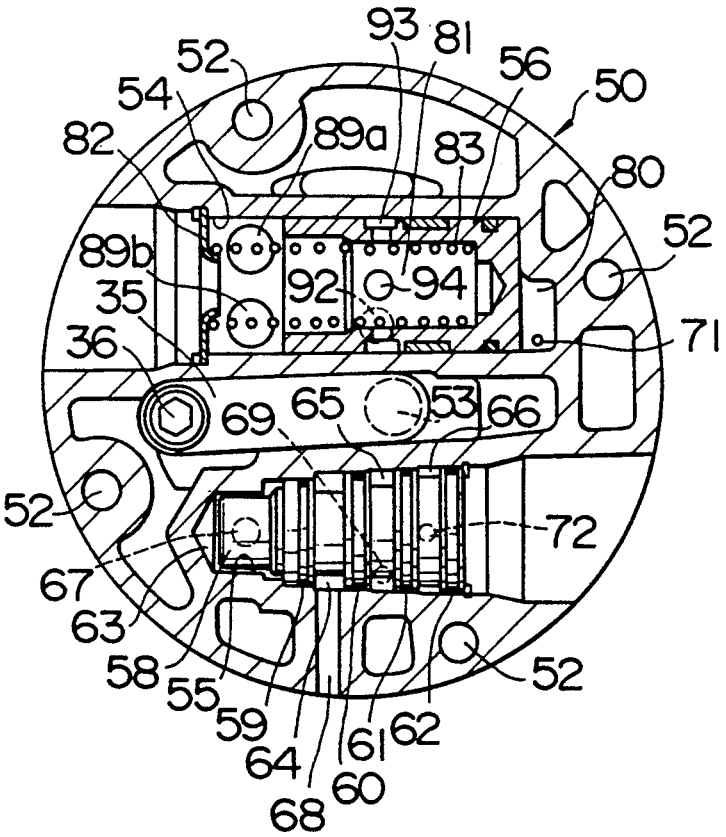
Figure 4:
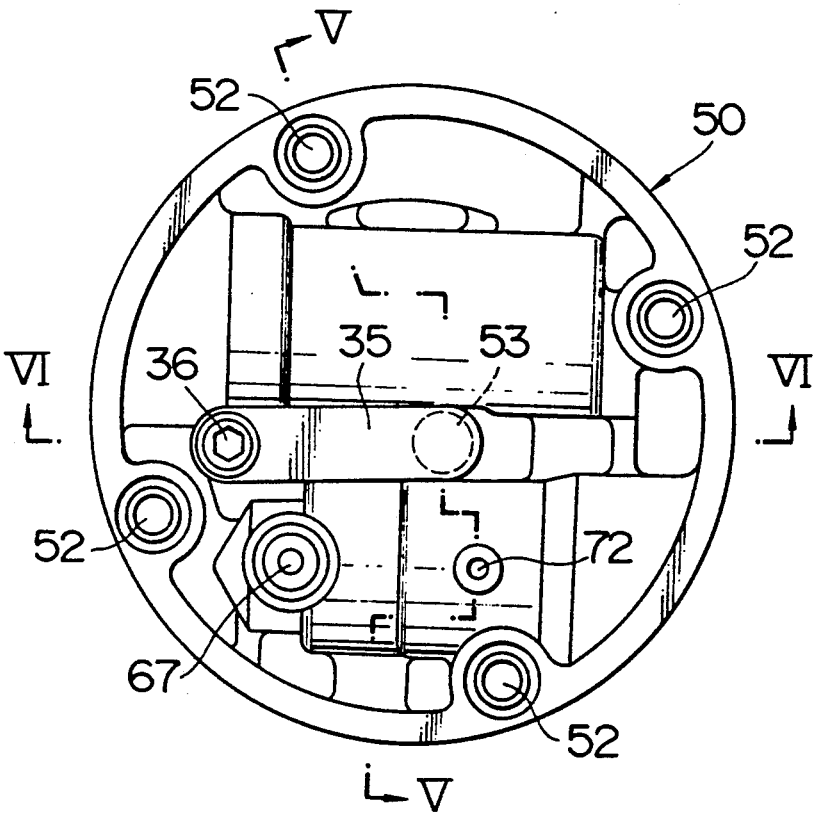
Figure 5:
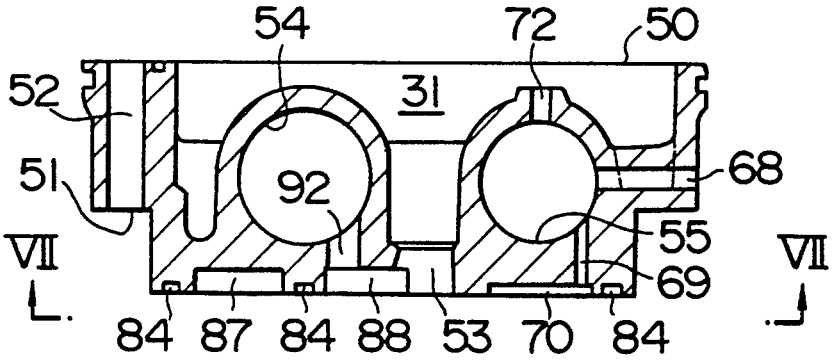
Figure 6:
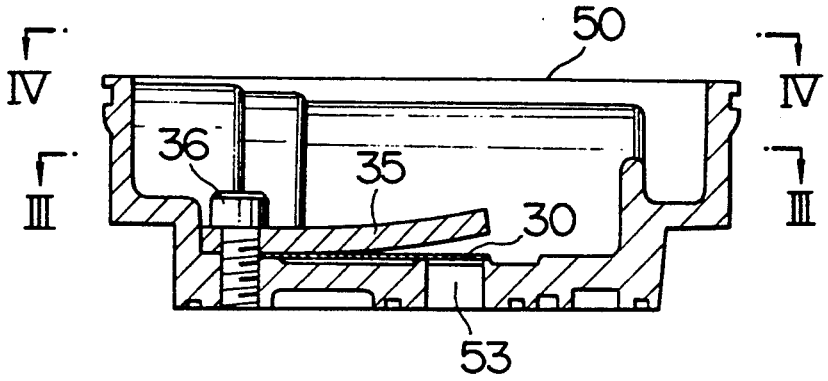

FIG. 1 thru FIG. 7 show an embodiment of the present invention.

A pair of bypass ports 33*a* and 33*b* which communicate with compression chambers 19*a* and 19*b* are bored in an end plate 11 of a stationary scroll 10. A capacity control block 50 is arranged so as to come into close contact with the outer surface of the end plate 11 of the stationary scroll 10. The capacity control block 50 is fixed in a housing 1 together with the stationary scroll 10 by fitting a fitting recessed portion 51 provided thereon to a fitting projected portion 10*a* provided on the stationary scroll 10, having a bolt 13 pass through a bolt hole 52 bored in the cup-shaped main body 2 and the capacity control block 50 from the outside of the housing 1 and screwing the point end thereof into the stationary scroll 10.

Then, the inside of the housing 1 is partitioned into a suction chamber 28 and a discharge cavity 31 by having the rear outer circumferential surface of the capacity control block 50 come into close contact hermetically with the inner circumferential surface of the cup-shaped main body 2.

A discharge hole 53 communicating with a discharge port 29 is bored at the central part of the capacity control block 50, and this discharge hole 53 is opened and closed by means of a discharge valve 30 fastened to the outside surface of the capacity control block 50 with a bolt 36 together with a retainer 35.

A cylinder 54 having a blind hole shape is bored on one side of the discharge hole 53, and a hollow cavity 55 having a blind hole shape is bored in parallel with the cylinder 54 on another side, respectively, and opening ends of the cylinder 54 and the hollow cavity 55 communicate with the suction chamber 28, respectively.

A cup-shaped piston valve 56 is contained in the cylinder 54 in a sealed and slidable manner, and a control pressure chamber 80 is delimited on one side of the piston valve 56 and a chamber 81 delimited on another side communicates with the suction chamber 28. Further, this piston valve 56 is pushed toward the control pressure chamber 80 by a coil spring 83 interposed between the piston valve 56 and a spring shoe 82. Further, a ring recessed groove 93 bored on the outer circumferential surface of the piston valve 56 always communicates with the chamber 81 through a plurality of holes 94.

On the other hand, a control valve 58 is fitted into the hollow cavity 55, and an atmospheric pressure chamber 63, a low pressure chamber 64, a control pressure chamber 65 and a high pressure chamber 66 are delimited by partitioning a clearance between the hollow cavity 55 and the control valve 58 with O-rings 59, 60, 61 and 62. Further, the atmospheric pressure chamber 63 communicates with atmospheric air outside the housing 1 through a through hole 67 and a connecting pipe not shown. The low pressure chamber 64 communicates with the suction chamber 28 through a through hole 68, the control pressure chamber 65 communicates with the control pressure chamber 80 through a through hole 69, a recessed groove 70 and a through hole 71, and the high pressure chamber 66 communicates with the discharge cavity 31 through a through hole 72.

Thus, the control valve 58 senses a high pressure HP in the discharge cavity 31 and a low pressure LP in the suction chamber 28, and generates a control pressure AP which is an intermediate pressure of these pressures and may be expressed as a linear function of a low pressure LP similarly to the conventional control valve 38.

Figure 7:
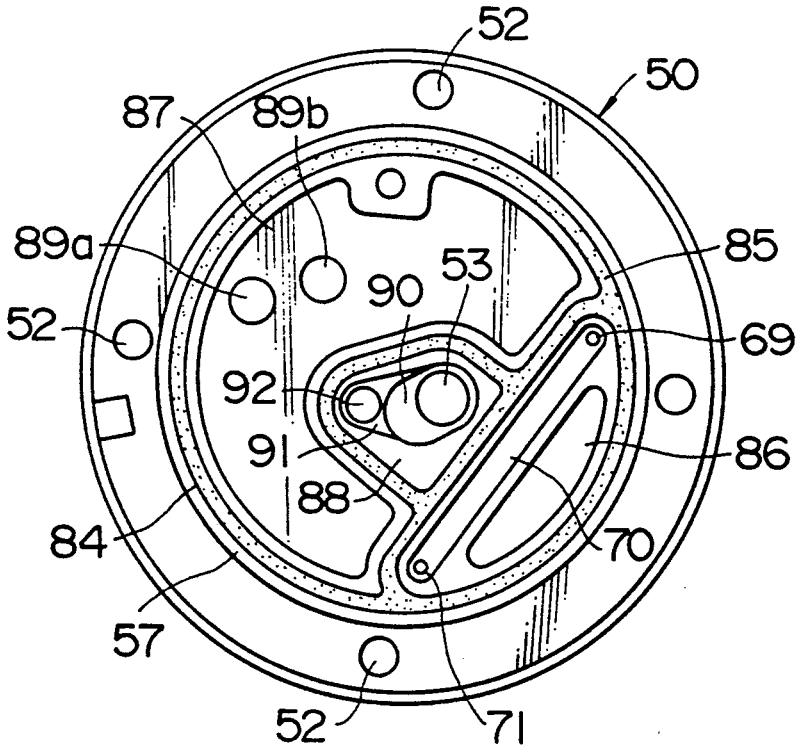

As shown in FIG. 7, recessed grooves 70, 90 and 91, a first recessed portion 86, a second recessed portion 87 and a third recessed portion 88 are bored on the inner surface of the capacity control block 50. A seal material 85 is fitted in a seal groove 84 bored at a land portion 57 surrounding these first, second and third recessed portions 86, 87 and 88. By having this seal material 85 come into close contact with the outer surface of the end plate 11 of the stationary scroll 10, these first, second and third recessed portions 86, 87 and 88 are formed between the capacity control block 50 and the outer surface of the end plate 11, and partitioned by means of the seal material 85. The first recessed portion 86 communicates with the control pressure chambers 65 and 80 through the recessed groove 70 and the through holes 69 and 71, the second recessed portion 87 communicates with compression chambers 19*a* and 19*b* which are being compressed through a pair of bypass ports 33*a* and 33*b* bored in the end plate 11 and communicates also with the chamber 81 of the cylinder 54 via through holes 89*a* and 89*b*, and the third recessed portion 88 communicates with a discharge hole 53 through the recessed grooves 90 and 91 and communicates also with the chamber 81 of the cylinder 54 through a communication hole 92.

Besides, the bypass ports 33*a* and 33*b* are disposed at positions to communicate with the compression chambers 19*a* and 19*b* during the period until the compression chambers enter into a compression process after terminating suction of gas, and the volume thereof is reduced to 50%.

Figure 8:
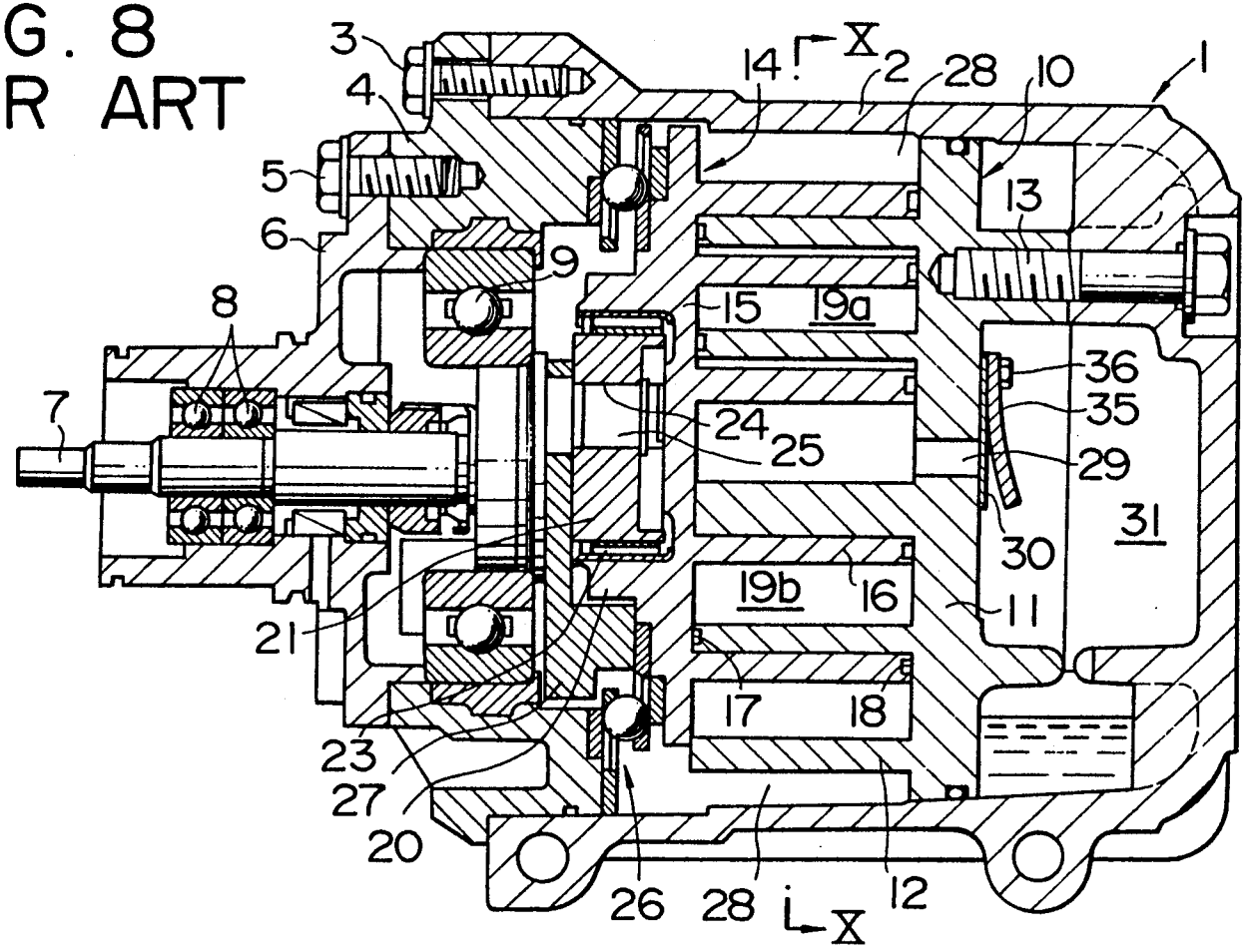
FIG. 8 PRIOR ART
Figure 9:
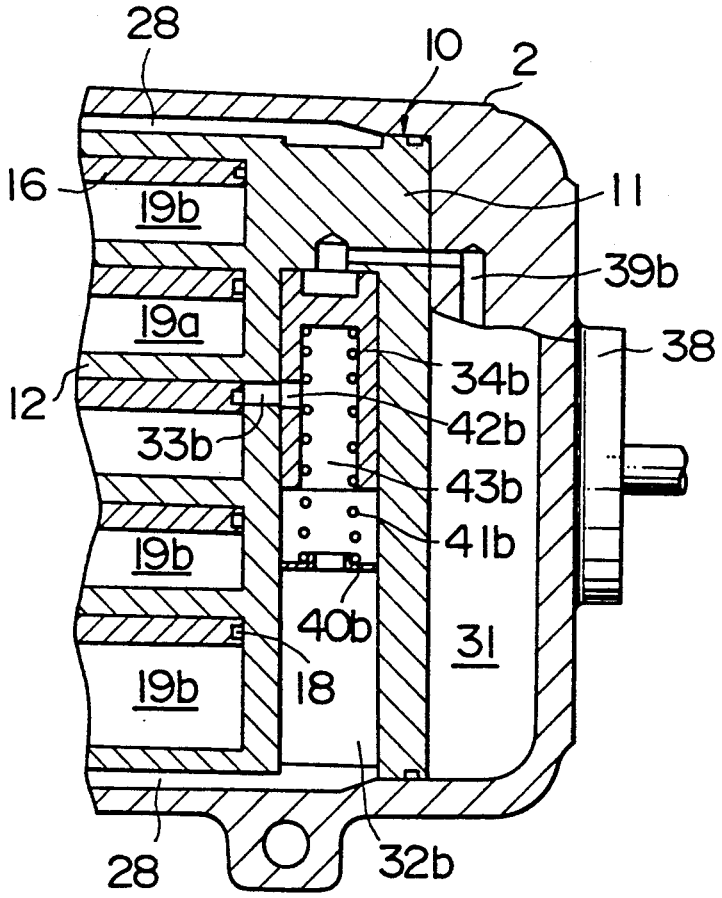
FIG. 9 PRIOR ART
Figure 10:
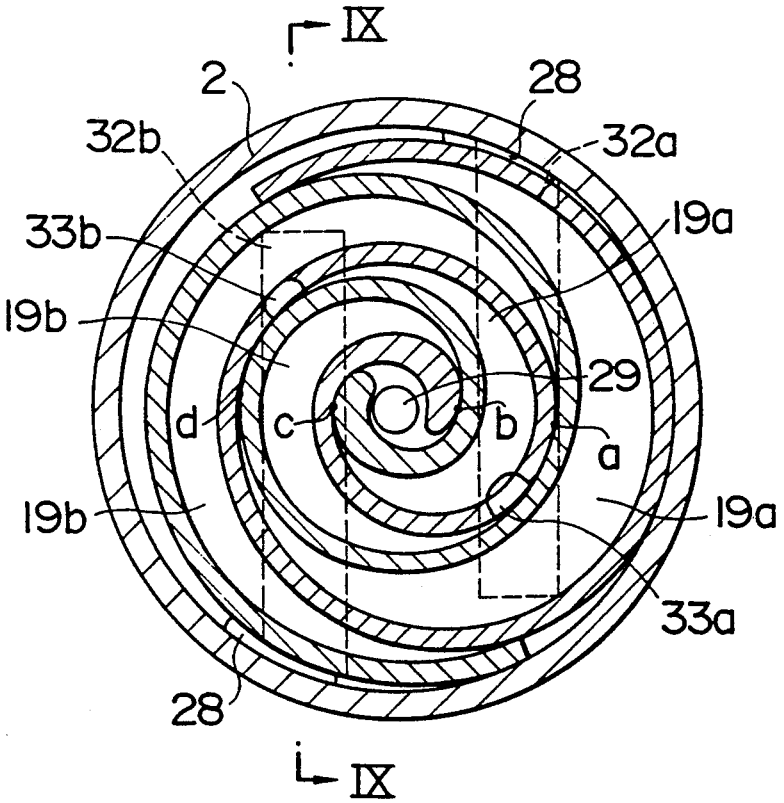
FIG. 10 PRIOR ART

Other construction is the same as that of a conventional apparatus illustrated in FIG. 8 thru FIG. 10, and the same reference numerals are affixed to corresponding members.

When the compressor is in an unload operation, the control pressure AP generated at the control valve is lowered. When this control pressure AP is introduced into the control pressure chamber 80 through the through hole 69, the recessed groove 70 and the through hole 71, the piston valve 56 is pushed by a restoring force of the coil spring 83 and occupies a position shown in FIG. 3. Since the communication holes 89*a* and 89*b* and the communication hole 92 are thus opened, gas which is being compressed in the compression chambers 19*a* and 19*b* enters into the chamber 81 through the bypass ports 33*a* and 33*b*, the second recessed portion 87, and the communication holes 89*a* and 89*b*. On the other hand, the gas in the compression chamber which has reached the center of the spiral, viz., the gas after compression enters into the chamber 81 through the discharge port 29, the discharge hole 53, the third recessed portion 88, recessed grooves 90 and 91, and the communication hole 92. These gases join together in the chamber 81 and are discharged into the suction chamber 28. As a result, the output capacity of the compressor becomes zero.

When the compressor is in full-load operation, the control valve 58 generates a high control pressure AP. Then, the high control pressure AP enters into the control chamber 80, and presses the inner end surface of the piston valve 56. Thus, the piston valve 56 moves back against the resiliency of the coil spring 83, and occupies a position where the outer end thereof abuts against the spring shoe 82, viz., a position shown in FIG. 2. In such a state, all of the communication holes 89*a* and 89*b* and the communication hole 92 are blocked by means of the piston valve 56. Therefore, the gas which is compressed in the compression chambers 19*a* and 19*b* and reaches the central part of the spiral passes through the discharge port 29 and the discharge hole 53, and pushes the discharge valve 30 open so as to be discharged into the discharge cavity 31, and then discharged outside through a discharge port not shown.

When the output capacity of the compressor is reduced, a control pressure AP corresponding to a reduction rate is generated in the control valve 58. When this control pressure AP acts on the inner end surface of the piston valve 56 through the control pressure chamber 80, the piston valve 56 comes to a standstill at a position where the pressing force by the control pressure AP and the resiliency of the coil spring 83 are equilibrated. Accordingly, only the communication holes 89*a* and 89*b* are opened while the control pressure AP is low, the gas which is being compressed in the compression chambers 19*a* and 19*b* is discharged into the suction chamber 28 by the quantity corresponding to the opening of the communication holes 89*a* and 89*b*, and the output capacity of the compressor is reduced down to 50% when the communication holes 89*a* and 89*b* are fully opened. Furthermore, when the control pressure AP is lowered, the communication hole 92 is opened, and the output capacity of the compressor becomes zero when it is fully opened. In such a manner, it is possible to have the output capacity of the compressor vary from 0 % to 100% linearly.

In the above-described embodiment, a bypass passage is formed of the chamber 81, the communication holes 89*a*, 89*b* and 92 and the like of the cylinder 54, and this bypass passage is opened and closed by means of the piston valve 56. However, these bypass passage and piston, valve are not limited to those that are shown in the figures, but it is a matter of course that variety of constructions and configurations may be adopted.

According to the present invention, the capacity control block is formed separately from the stationary scroll, and this capacity control block is made to come into close contact with the outer surface of the stationary scroll. Thus, working of the stationary scroll and the capacity control block becomes easier, and the costs thereof may be reduced by a large margin.

Further, the bypass passage for having bypass ports communicate with the suction chamber, the piston valve for opening and and closing the bypass passage, and the control valve which generates a control pressure for operating this piston valve are contained inside the capacity control block. It is therefore possible to obtain a fixed capacity type compressor by removing them without requiring special modification of the stationary scroll and the housing.

Further because, a piston valve and a control valve are contained inside the capacity control block installed in the housing, it is possible to introduce a discharge pressure and a suction pressure into the control valve easily and also to introduce a control pressure generated in the control valve into the piston valve easily. Moreover, since the control valve is not projected out of the housing, it is possible to make the external dimension of the compressor smaller and also to prevent breakage of the control valve due to collision. Also, it is possible to simplify the seal structure of the control valve and to reduce time for assembly.

Furthermore, by installing the piston valve and the control valve in parallel with each other, they may be contained inside the capacity control block easily and the capacity control block is made smaller in size. Hence, it is possible easily incorporate the capacity control block in the housing.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A scroll type compressor comprising a housing having a suction chamber, a stationary scroll and a revolving scroll, the stationary scroll and revolving scroll each having spiral wraps on end plates thereof which engage each other while shifting an angle therebetween so as to form compression chambers, said stationary scroll being installed fixedly in the housing, said revolving scroll being rotatable in a solar motion by means of a mechanism for driving revolution while checking rotation on an axis thereof, said compression chambers being thereby moved toward a center of the spiral while reducing volumes thereof so as to compress gas, with the compressed gas being discharged into a discharge cavity formed in the housing through discharge ports provided in the end plate of said stationary scroll, bypass ports being provided in the end plate of the stationary scroll, the bypass ports communicate with said compression chambers, the scroll type compressor further comprising a capacity control block with a bypass passage, the bypass passage communicates the bypass ports with the suction chamber formed in said housing, a piston valve being provided which opens and closes the bypass passage, and a control valve being provided which senses a discharge pressure and a suction pressure and generates a control pressure or operating said piston valve, the capacity control block, piston valve and control valve being formed separately from said stationary scroll and being completely contained within said housing, the capacity control block abuts an outer surface of the end plate of said stationary scroll and is installed fixedly within the housing.

2. The scroll type compressor according to claim 1, wherein said piston valve and said control valve are installed generally in parallel with each other.

3. The scroll type compressor according to claim 1, further comprising:

a through hole communicating with said discharge cavity for introducing a discharge pressure and a through hole communicating with said suction chamber for introducing a suction pressure into said control valve are provided in said capacity control block; and a passage for introducing the control pressure from said control valve to one end side of said piston valve in formed as a recessed groove provided a surface of the capacity control block which contacts said stationary scroll, a through hole is provided communicating with said recessed groove and communicates with the control pressure chamber of said control valve, and a through hole is provided communicating with one end side of said piston valve.

4. The scroll type compressor according to claim 2, further comprising a discharge hole communicating with said discharge port being provided between said piston valve and sad control valve of said capacity control block, and a discharge valve being installed on the discharge cavity side of the discharge hole.

5. The scroll type compressor according to claim 1, wherein the capacity control block has a first and second side, the first and second sides of the capacity control block being opposed sides and the side of the capacity control block which abuts the outer surface of the end plate of said stationary scroll being the first side, the discharge cavity being formed by the housing and the second side of the capacity control block.

6. The scroll type compressor according to claim 1, wherein the capacity control block has a cylinder bored therein in which the piston valve is located and has a hollow cavity formed therein in which the control valve is located, the cylinder further having a spring located therein, the spring urges the piston valve in a first direction.

7. The scroll type compressor according to claim 6, wherein the piston is movable in a second direction, the second direction being opposite to the first direction, the piston and cylinder forming a control pressure chamber, the spring urges the piston in the first direction to reduce the size of the control pressure chamber.

8. The scroll type compressor according to claim 7, wherein the control pressure chamber is in communication with a second control pressure chamber, the control valve with the hollow cavity forming the second control pressure chamber as well as an atmospheric pressure chamber, a low pressure chamber and a high pressure chamber.

9. The scroll type compressor according to claim 1, wherein the control valve is positioned within a hollow cavity in the capacity control block, the control valve and hollow cavity forming an atmospheric pressure chamber, a low pressure chamber, a control pressure chamber and a high pressure chamber.

10. The scroll type compressor according to claim 9, wherein the capacity control block has a plurality of recessed portions formed on the side thereof which abuts the outer surface of the end plate of said stationary scroll, a seal being provided around each of the plurality of recessed portions, the seal being in contact with the outer surface of the end plate of the stationary scroll.

11. The scroll type compressor according to claim 10, wherein three recessed portions are provided on the capacity control block, the first recessed portion communicates the control pressure chamber of the control valve with a control pressure chamber formed by the piston valve, the second recessed portion communicates with the compression chambers through the bypass ports in the end plate of the stationary scroll, the second recessed portion also communicates with the control pressure chamber formed by the piston valve, and the third recessed portion communicates with a centrally located discharge hole in the end plate of the stationary scroll and communicates with control pressure chamber formed by the piston valve.

12. The scroll type compressor according to claim 1, wherein the capacity control block has a plurality of recessed portions formed on the side thereof which abuts the outer surface of the end plate of said stationary scroll, a seal being provided around each of the plurality of recessed portions, the seal being in contact with the outer surface of the end plate of the stationary scroll.

* * * * *